US006514150B1

(12) United States Patent
Corder

(10) Patent No.: US 6,514,150 B1
(45) Date of Patent: Feb. 4, 2003

(54) ADJUSTABLE ELBOW ANGLE GOLF SWING TRAINER

(76) Inventor: William Corder, 1206 Stonehurst Rd., Anderson, SC (US) 29621

( * ) Notice: Subject to any disclaimer, the term of this patent is extended or adjusted under 35 U.S.C. 154(b) by 0 days.

(21) Appl. No.: 09/493,464

(22) Filed: Jan. 28, 2000

(51) Int. Cl.[7] ..... A63B 69/36
(52) U.S. Cl. ..... 473/214; 473/409
(58) Field of Search ..... 473/214, 212, 473/276, 207; 602/20

(56) References Cited

U.S. PATENT DOCUMENTS 475,432 A * 5/1892 Blades ..... 473/212
1,457,710 A * 6/1923 MacDonald ..... 473/212
4,254,953 A * 3/1981 Marchetti ..... 473/212
4,612,919 A * 9/1986 Best ..... 602/20
5,076,587 A * 12/1991 Manley ..... 473/214
5,344,152 A * 9/1994 Brannen ..... 473/214
5,395,117 A * 3/1995 Ogden ..... 473/214
5,472,206 A * 12/1995 Manley et al. ..... 473/214

* cited by examiner

*Primary Examiner*—Steven Wong
*Assistant Examiner*—Raeann Gorden
(74) *Attorney, Agent, or Firm*—Robert Nathans

(57) ABSTRACT

A golf swing elbow angle control device for various types of golf shots, e.g. ninety degrees for long wood drives, and lesser angles for iron drives and chip shots. The device is readily adjustable, providing easy and rapid changes in its elbow angle control function, and customized fiducial settings of the device for various types of shots are readily established for the players having different forearm and elbow sizes and shapes. The device also functions as a convenient anchor for an elastic belt extending around the opposite upper arm of the player, keeping the arms together to provide a simple and easy way to prevent the player's elbows from extending away from the body, which is detrimental to good golf swing form.

20 Claims, 3 Drawing Sheets

ADJUSTABLE ELBOW ANGLE GOLF SWING TRAINER

BACKGROUND OF THE INVENTION

The present invention relates to the field of golf training devices.

The cocking and uncocking of the right arm is a substantial power source during golf club swinging, and the elbow bend of the right arm determines in large part how far the ball goes. In order to help the player improve his or her golf swing, various devices have been developed over the years which attempt to maintain the player's arms and elbows in desired positions during swing of the golf club. In Staats U.S. Pat. No. 5,529,306 an elongated rod is mechanically coupled between the right forearm and the left upper arm or chest for providing a measure of proper forearm positioning during swing of the golf club. The use of this large elongated rod is awkward and the proper adjustment for the chip shot versus the drive shot is tedious. The elastic bands would have to contact multiple body portions of the golf students, as in the complex and cumbersome Manley U.S. Pat. Nos. 5,472,206 and 5,076,587, the latter having a complicated movable pivoting device attached at three places to the player's anatomy. See also Latella, U.S. Pat. No. 5,839,968 wherein a large ball is held between the arms of the golfer while swinging the club.

A simpler and more compact device is taught in Brannen U.S. Pat. No. 5,344,152, wherein a plastic L-shaped member 10 is strapped to the upper arm of the player by a hook-and-loop type fastener. The elbow angle, as defined herein, is zero when the fore-arm is extended out straight with respect to the upper arm and away from the body of the player. When player elbow bending during his golf club swing tends to become greater than ninety degrees, to produce an undesired obtuse elbow bending angle, the L-shaped member is placed in compression to prevent the forearm from forming this undesired angle and hence maintains the elbow bending angle at 90 degrees. However, this device is limited to preventing elbow bending to form a angle of greater than ninety degrees between the forearm and upper player arm; it has no control of elbow bending angles that are less than ninety degrees, as is a desired goal of the present invention.

Ogden U.S. Pat. No. 5,395,117 also discloses an L-shaped member which is basically for maintaining the ninety degree elbow bend during the club swing. However, there is a suggestion of varying this angle by folding the arm to the desired angle and shifting the position of the device and then affixing the L-shaped member to the upper arm to attempt to provide control of a lesser elbow angle of less than ninety degrees. In the case of "Velcro" hook and eye type fasteners, or any other fasteners, removing and reattaching the Velcro straps for different types of upcoming shots would be a time consuming nuisance, and furthermore will result in inaccurate shifted placement of the L-shaped member on the upper arm, in tun producing inaccurate elbow angle control.

Another detrimental player habit which would be desirable to control during swing of the golf club is "chicken winging" whereby during swing of the club, the player's elbows extend or "fly" outwardly to an undesired extent, away from the player's body, and hence her arms are not maintained equidistant from each other, as is desired for good form.

SUMMARY OF A PREFERRED EMBODIMENT OF THE INVENTION

The aforesaid goals and benefits are met by providing a golf swing elbow angle control device that is relatively simple, inexpensive to manufacture, and yet provides good elbow angle control for various types of golf shots, e.g. ninety degrees for drives, 45 degrees for iron drives and lesser angles typically fifteen degrees for chip shots. Importantly, the device is readily adjustable, providing easy and rapid changes in its elbow angle control function for each type of upcoming shot. Customized fiducial settings of the device for various types of shots are readily established for the players having different forearm and elbow sizes and shapes. This results in quick and accurate elbow angle control settings. Furthermore, the upper arm mounted elbow angle control device, at the same time, has the dual function of a convenient anchor for an elastic belt extending 180 degrees around the opposite upper arm of the player, keeping the arms together to provide, at the same time, a simple and easy way to prevent the aforesaid "chicken winging," which is detrimental to good golf swing form.

BRIEF DESCRIPTION OF THE DRAWINGS

The various features of the invention will become more apparent upon reading of the following detailed description, taken in conjunction with the drawings in which.

DETAILED DESCRIPTION OF PREFERRED EMBODIMENTS OF THE INVENTION

Figure 1:
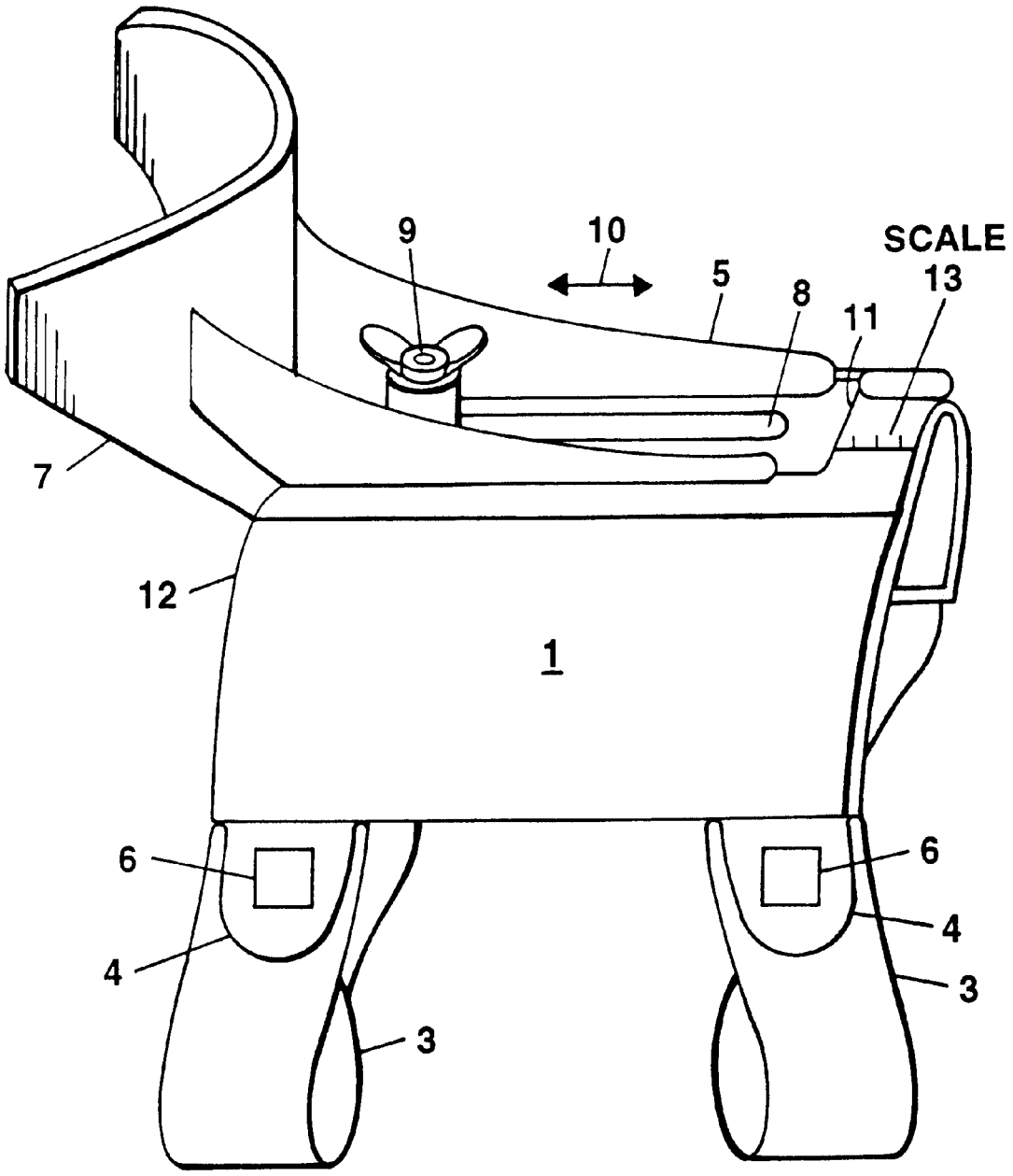
FIG. 1 illustrates a perspective view of a preferred training device of the invention.
Figure 2:
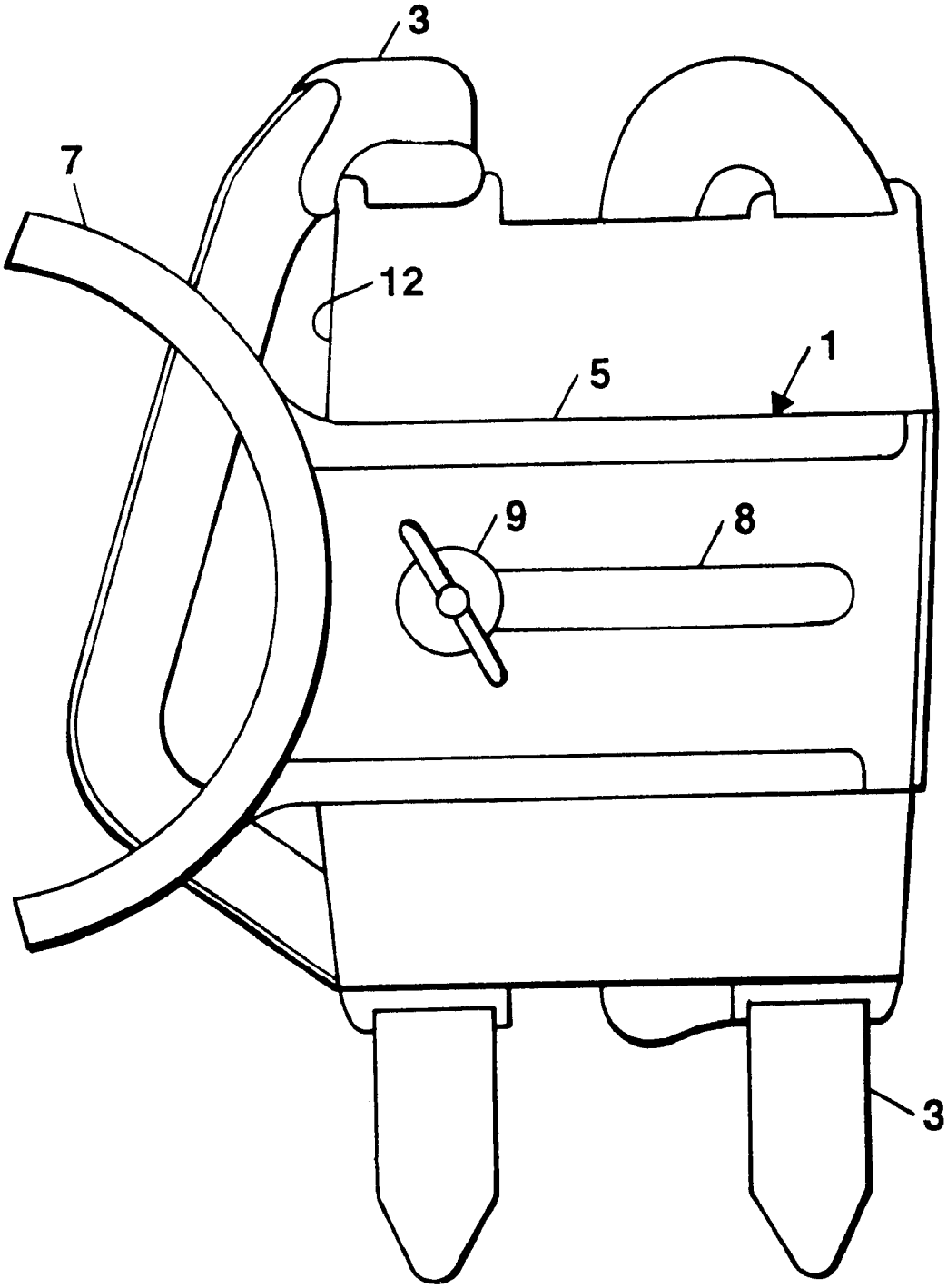
FIG. 2 illustrates a top view of the FIG. 1 embodiment.

In FIG. 1, a base member 1 is coupled to the upper arm portion of the player by base member mounting belt members 3. An elongated spacer member 5 is slidably coupled to base member 1 by an adjustable wing nut coupling device 9, seated within elongated slot 8, for coupling and uncoupling the forearm spacer member 5 to and from the base member. Mounting belt members 3 comprise standard attaching belts similar to those used to attach portable blood pressure measuring devices to the upper arms of the user. Such belts have terminal belt portions 4 coupled to adjacent belts portions via conventional "Velcro" hook-and-eye fasteners 6.

Terminal portion 11 of slidable spacer 5 cooperates with a numbered fiducial scale 13 formed upon base member 1. Terminal portion 12 of elongated spacer member 5 is connected to a forearm contact member 7 which preferably comprises a resilient member such as padded foam for contacting the forearm of the player, for preventing bruising of the forearm during swing of the golf club.

The base member 1 is thus strapped to the upper right arm of a right hand player via belts 3 and at a position whereby terminal portion 12 of the base member abuts the elbow joint of the player. In this position, the elbow angle is established at approximately ninety degrees which is the proper angle for a long distance drive with a wood driver. An appropriate translatable adjustment of the slidable spacer member can be made to more accurately establish this angle if desired. This adjustment controls the effective length of the forearm-upper arm spacer means. Now, when an intermediate drive iron shot is to be made, the wing-nut coupler 9 is released to permit the spacer to be displaced a distance which will limit the player's elbow angle to 45 degrees; and the wing-nut coupler is now tightened. The numbered fiducial marking setting for this angle, established by the relative positioning of terminal portion 11 and fiducial scale 13, will visually indicate to the player when this 45 degree elbow angle limit is to be established by the re-tightening of the wing nut coupler at this time. This particular numerical setting indicated by the fiducial scale, and customized for the particular player, can be recorded on a player card next to "iron shot." In like manner, the appropriate elbow angle limit of fifteen degrees can be established for pitching and chipping shots and the numerical fiducial scale setting for fifteen degrees is recorded on the player's card. Thus, once the customized fiducial settings are recorded, elongated spacer member 5, slidable to-and-fro as indicated by arrow 10, is easily and rapidly positioned for each upcoming type of shot.

Accordingly, the golf instructor, or the purchaser of the device using the accompanying instructions, will initially mount the device to the upper arm of the player against the elbow joint, adjust the spacer member to establish the proper 90-45-15 degree elbow angle limits and while doing so, will record the numbered fiducial settings of fiducial scale device at 11 and 13, associated with these elbow limit angles. Later, the player or his instructor can use these number settings, after being written down on the player's card as described, to appropriately set the position of the slidable spacer for the desired type of shot. Since the physical sizes and shapes of the arms of the players are variable, these fiducial scale settings will be beneficially customized for each individual player.

Figure 3:
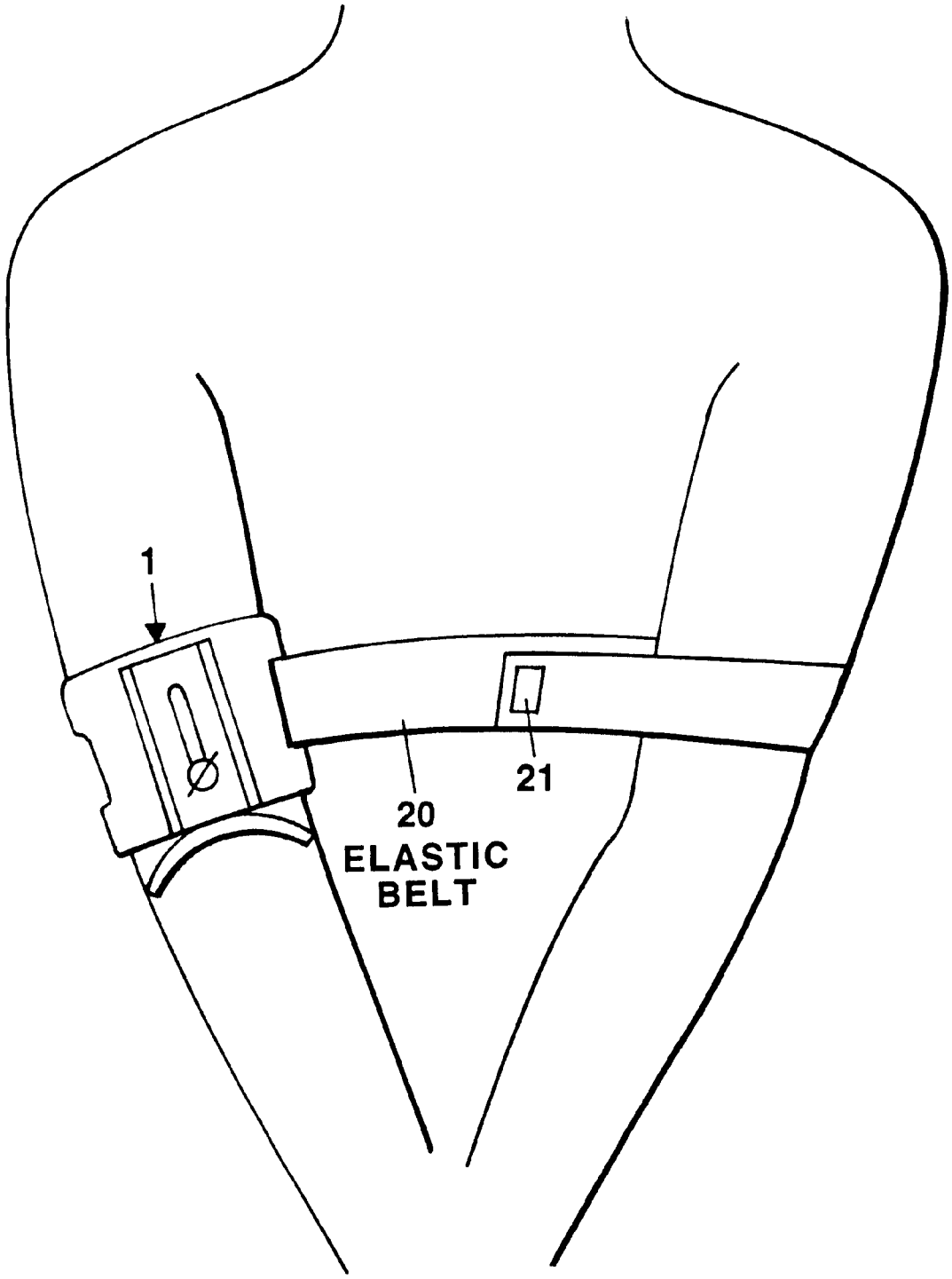
FIG. 3 illustrates the device attached to the opposite arm of the player for preventing "chicken winging."

The base mounting means besides functioning as described, advantageously has the dual function of acting as an anchor for an elasticized belt 20, shown in FIG. 3, which extends up to, and is passed 180 degrees about, the upper arm portion of the player, opposite the aforesaid player upper arm portion supporting the base member. It thereafter is looped back parallel with itself and is affixed to the base mounting means via a conventional spring-hook fastener 21. Thus, the elasticized belt substantially surrounds the second upper arm portion but not the main body portion of the player. This elasticized belt 20 is a simple means for preventing the elbows of the player from extending too far away from the body during the golf swing, to produce "chicken winging", which is a detrimental habit common amongst beginners.

While specific embodiments of the invention have been described, variations will occur to the worker in the art and thus the scope of the invention is to be limited only by the terms of the following claims and art recognized equivalents thereof For example, the term "belt" is intended to include other elongated means encircling the upper arm portions of the player such as elongated springs, cords and the like. The term "elasticized belt" is intended to include a nonelastic belt resiliently coupled to the base anchor member via a spring. The end portion of the spacer means could conceivably serve as the forearm contact means without employing a separate contact means such as a foam pad, U-shaped yoke or the like. It also may be possible to mount the base member to the forearm rather than to the upper arm although this would appear to be far more awkward. The forearm spacer means could comprise two overlapping partial cylinders rotated with respect to each other about a hinge member in the base of the device, coupled between two base member plates at the elbow joint, to establish the angle limit, rather than being translated as shown. While the invention has been described as a golf training device, it may be applied, in perhaps a limited way, to the training of other players, learning other games such as basketball, where control of the player's elbow angle is significant. For example, in basketball the elbow angle should be ninety degrees while shooting for a basket.

What is claimed is:

1. A method for helping to teach a golfer how to properly swing a golf club comprising the steps of:

(a) providing an elbow angle control device having (a-1) a base member for mounting the base member solely upon an upper arm portion of a golfer and not upon a forearm portion of a golfer;

(a-2) forearm spacer means movable with respect to said base member;

(a-3) forearm contact means coupled to said forearm spacer means for enabling contact with a forearm portion of a golfer without being mounted thereon;

(a-4) adjustable coupling means for coupling and uncoupling said forearm spacer means to and from said base member, for enabling said forearm spacer means to maintain a selected position relative to said base member during swinging of a golf club by a golfer for in turn controlling a golfer's elbow angle;

(b) affixing said base member of said elbow arm control device to an upper arm portion of a golfer but not to a forearm portion of a golfer; and (c) shifting the relative position of said forearm spacer means with respect to said base member by manipulating said adjustable coupling means to accommodate different types of golf shots.

2. The method of claim 1 further including:

(d) substantially encircling a second upper arm portion of a golfer, opposite an upper arm portion of a golfer, with an elasticized belt for constraining outward elbow positioning while swinging a golf club; and (e) attaching said belt to said elbow angle control device.

3. The method of claim 2 wherein step (d) comprises encircling solely a second upper arm portion of a golfer with said elasticized belt.

4. The method of claim 1 further including:

(d) passing an elasticized belt, having a first total belt portion attached to said elbow angle control device, up and around a second upper arm portion of a golfer opposite the first mentioned upper ann portion; and (e) thereafter attaching a second terminal belt portion to said base member.

5. A sports training device for teaching a golfer proper upper body form during swing of a golf club comprising:

(a) an elbow angle control device having (b) a base member including means for affixing the base member solely to a first arm portion of a golfer but not to a second arm portion of a golfer having first and second arm portions separated by an elbow portion;

(c) movable forearm spacer means coupled solely to said base member;

(d) second arm portion contact means coupled to said forearm spacer means for enabling contact with a second arm portion of a golfer during swing of a golf club without being mechanically affixed to a second arm portion; and (e) adjustable coupling means for coupling and uncoupling said forearm spacer means to and from said base member for enabling said forearm spacer means to maintain a selected position relative to said base member, for in turn controlling an elbow angle of a golfer.

6. The sports training device of claim 5 further including an elasticized belt for substantially encircling a second upper arm of a golfer opposite a first upper arm of a golfer, and means for coupling said elasticized belt to said base member.

7. The sports training device of claim 5 including indicating means for visually indicating which position said forearm-upper arm spacer means is currently assuming.

8. The spoils training device of claim 6 including indicating means for visually indicating which position said forearm-upper arm spacer means is currently assuming.

9. The sports training device of claim 7 wherein said indicating means comprises a scale having fiducial markings thereon.

10. The sports training device of claim 5 wherein said adjustable coupling means enables translational displacement only of said movable forearm spacer means with respect to said base member.

11. A golf training device for teaching a golfer how to properly swing a golf club comprising:

(a) a base member coupled to an upper arm portion of a golfer by base member mounting means;

(b) forearm spacer means coupled to said base member;

(c) forearm contact means coupled to said forearm spacer means for contacting a forearm of a golfer;

(d) adjustable coupling means for coupling and uncoupling said forearm spacer means to and from said base member, enabling said forearm spacer means to selectively maintain at least two selected positions relative to said base member during swinging of a golf club by a golfer for in turn controlling the elbow angle of a golfer and further including;

(e) a belt substantially encircling a second upper arm portion of a golfer opposite an upper arm portion of a golfer having said base member coupled thereto, and belt attaching means for attaching said belt to said base member.

12. The golf training device of claim 11 including position indicating means for indicating the relative position of said forearm spacer means with respect to said base member.

13. The golf training device of claim 11 wherein said belt is an elasticized belt.

14. The golf training device of claim 12 wherein said belt is an elasticized belt.

15. The golf training device of claim 11 wherein said forearm contact means comprises a resilient contact member for preventing application of a high impulse force to a forearm by said forearm spacer means during swinging of a golf club, thereby to deter bruising of a forearm.

16. The golf training device of claim 12 wherein said forearm contact means comprises a resilient contact member for preventing application of a high impulse force to said forearm by said forearm spacer means during swinging of a golf club, thereby to deter bruising of said forearm.

17. The golf training device of claim 13 wherein said forearm contact means comprises a resilient contact member for preventing application of a high impulse force to a forearm by said forearm spacer means during swinging of a golf club, thereby to deter bruising of a forearm.

18. The golf training device of claim 12 wherein said position indicating means includes fiducial markings positioned over said base member.

19. The golf training device of claim 14 wherein said position indicating means includes fiducial markings positioned over said base member.

20. The golf training device of claim 16 wherein said position indicating means includes fiducial markings positioned over said base member.

* * * * *